US005564970A

United States Patent [19]

Olson et al.

[11] Patent Number: 5,564,970

[45] Date of Patent: Oct. 15, 1996

[54] METHOD AND APPARATUS FOR CREATING OR RESTORING HIGH FRICTION SURFACE TO MEDIA ROLLER

[75] Inventors: Allan G. Olson, Camas; Kieran B. Kelly, Vancouver; Shannon D. Casey, Camas; Blair M. Kent, Vancouver, all of Wash.

[73] Assignee: Hewlett-Packard Company, Palo Alto, Calif.

[21] Appl. No.: 340,778

[22] Filed: Nov. 17, 1994

[51] Int. Cl.[6] ..... B24B 19/00

[52] U.S. Cl. ..... 451/428; 451/444; 355/309

[58] Field of Search ..... 451/426, 427, 451/488, 443, 444, 173, 108

[56] References Cited

U.S. PATENT DOCUMENTS

| | | | |
|---|---|---|---|
| 874,010 | 12/1907 | Johnson . | |
| 2,589,620 | 3/1952 | Leffel | 451/444 |
| 2,712,207 | 7/1955 | Cochran | 451/428 |
| 3,477,083 | 11/1969 | Park | 15/104 |
| 3,477,084 | 11/1969 | Thomas | 15/104.93 |
| 3,481,727 | 12/1969 | Dickinson et al. | 451/428 |
| 4,196,245 | 4/1980 | Kitson et al. | 428/198 |
| 4,357,615 | 11/1982 | Yoshiharu et al. | 346/134 |
| 4,408,241 | 10/1983 | Ogawa | 360/128 |
| 4,436,780 | 3/1984 | Hotchkiss et al. | 428/198 |
| 4,515,466 | 5/1985 | Heisler | 355/15 |
| 4,603,069 | 7/1986 | Haq et al. | 428/76 |
| 4,611,361 | 9/1986 | Shinkai | 15/104.93 |
| 4,628,388 | 12/1986 | Kawabe | 360/128 |
| 4,686,132 | 8/1987 | Sumii et al. | 428/171 |
| 4,712,334 | 12/1987 | Ikezaki et al. | 451/444 |
| 4,761,326 | 8/1988 | Barnes et al. | 428/219 |
| 4,766,029 | 8/1988 | Brock et al. | 428/286 |
| 4,781,966 | 11/1988 | Taylor | 428/152 |
| 4,808,467 | 2/1989 | Suskind et al. | 428/284 |
| 4,810,571 | 3/1989 | Guthrie | 428/286 |
| 4,906,513 | 3/1990 | Kebbell et al. | 428/198 |
| 4,933,015 | 6/1990 | White | 134/6 |
| 5,053,157 | 10/1991 | Lloyd | 252/91 |
| 5,075,919 | 12/1991 | Rogers et al. | 15/210 R |
| 5,116,034 | 5/1992 | Trask et al. | 271/2 |
| 5,153,964 | 10/1992 | Gelardi et al. | 15/229 |
| 5,223,329 | 6/1993 | Amann | 428/198 |
| 5,227,844 | 7/1993 | Bhattacharjee et al. | 355/215 |

FOREIGN PATENT DOCUMENTS 2039898 10/1992 Canada .

OTHER PUBLICATIONS

Clean–A–Platen Cleaning Pads, Manufactured by Lee Products Co., Minneapolis, MN.

Platen Restorer & Cleaner Kit, Manufactured by J. Penner Corporation The Supplies Division, New Hope, PA.

*Primary Examiner*—D. S. Meislin

*Assistant Examiner*—Dona C. Edwards

[57] ABSTRACT

A method and apparatus is achieved for creating or restoring a high friction surface to a drive roller 52. Abrasive pads 12 define a scrubbing surface for acting upon a media roller's surface 54–58. As the roller's surface is scrubbed, creping occurs which increases the surface's coefficient of friction, and more particularly, the coefficient of friction between the roller and media sheet ("COF(rm)"). In one embodiment, the creping apparatus is formed by a pair of plates 16, 18 hinged along one edge 30 and open along an opposite edge 28. A spring 19 is positioned between the plates biasing the plates apart at the open end. One or more abrasive pads are attached to the outer surface of one plate 18. The spring is selected to provide a specific biasing force. To create or restore a high friction surface, the apparatus 10 is positioned adjacent to the roller 52. By approximately defining the force applied between the roller 52 and abrasive pads 12 and by using an abrasive pad of known grit, initially surface contaminants, if any, are scrubbed from the roller surface 54–58. As the scrubbing continues, the elastomer surface 54–58 begins to fatigue. Small pieces of rubber tear from the surface while scrubbing the fatigued surface. After several minutes of operation, the scrubbing action generates a creped surface having an increased coefficient of friction.

15 Claims, 2 Drawing Sheets

METHOD AND APPARATUS FOR CREATING OR RESTORING HIGH FRICTION SURFACE TO MEDIA ROLLER

BACKGROUND OF THE INVENTION

This invention relates to media handling devices having elastomeric rollers, and more particularly to a method and apparatus for creating or restoring a high friction surface to an elastomeric roller.

In media handling devices, such as computer printers and plain-paper fax machines, a sheet of media (e.g., paper, transparencies) is transported from an input tray to a position adjacent a device-head where the sheet receives graphic or text markings. The sheet then is transported into an output tray. Elastomeric rollers typically are used for transporting the media sheets along a media path. In particular a series of rollers positioned at intervals along the media path moves a sheet progressively through the media handling device.

Some media rollers have a continuous elastomeric surface contacting the media along the roller length. Other media handling devices, such as inkjet printers, typically include several elastomeric surfaces in parallel (e.g., "tires") along the length of each roller. The series of roller structures is driven by a motor(s) or other drive mechanism for spinning a respective roller structure. Each roller structure is referred to herein as a drive roller.

Effective Media Handling

To effectively transport a media sheet it is desirable that the sheet not slide or lift from the drive roller. It also is desirable that individual sheets be transported in series rather than being one of multiple overlapping sheets. To avoid sliding and multiple-sheet picking, the media handling device typically is configured so that a force is applied to the media normal to the drive roller. Also, the drive rollers preferably have a high friction surface. To apply the normal force a device is positioned adjacent to a drive roller. Typically, a known, controlled, substantially-normal force is applied by the device. Exemplary devices for applying the normal force include (i) a spring-loaded rigid roller, (ii) another elastomeric roller deformed slightly against the drive roller, (iii) a leaf-spring type of shim, or (iv) a plate biased by a spring or other mechanism.

When a media sheet is interposed between the drive roller and the device applying the normal force, the media is encouraged to follow the motion of the drive roller. A quantitative measure of this "encouragement" is called the drive force, which is equal to the normal force times the coefficient of friction between the drive roller surface and the media sheet surface. To effectively pick and transport a media sheet, the drive force magnitude needs to sufficiently overcome drag forces imposed on the media sheet. These drag forces are attributed to friction. First, a drag component is attributable to friction between the media sheet and the device creating the normal force. Second, a drag component is attributable to friction between the media sheet and the adjoining media path, including sheet to sheet friction if the sheet is being picked from a stack of sheets. Third, a drag component is attributable to friction between the media sheet and a pick mechanism, such as a corner separator or a separator pad.

Corner separators are flaps located on one or both leading corners of a media stack. The drive force acts to create a buckle in affected corners of the media sheet, allowing the sheet to pop over the corner separators and move forward.

The drive force, however, is insufficient to create a buckle in underlying sheets, so that the top sheet is picked and moves past the underlying sheets.

A separator pad is a friction pad into which a leading edge of the media sheet is driven. The drive force of the top sheet is enough to overcome the drag of the friction pad and move forward. The drive, force, however, on the underlying sheets is insufficient to overcome the drag. Thus, the top sheet is picked and moves past the underlying sheets.

The friction forces occurring in the media handling device are determined in part by the coefficient of friction between the drive roller and the media sheet ("COF(rm)") and the coefficient of friction between respective media sheets ("COF(mm)"). The COF(mm) is controlled by the media manufacturer. The media handling device manufacturer typically is not the media manufacturer, and thus, can not readily control COF(mm). Accordingly, it is preferable for the media handling device manufacturer to choose COF(rm) to exceed all expected COF(mm) values by a comfortable margin.

Factors Affecting Media Rollers Coefficient of Friction

To achieve a high friction surface, it is desirable to provide a high coefficient of friction between the roller and a media sheet ("COF(rm)"). Factors affecting the COF(rm) include the base material of the roller surface, adjunct materials added to or modifying the base material, the finish of the surface, and cleaning chemicals applied to the surface during its useful life. With regard to base material selection, some materials have an inherently greater COF(rm). Selection, however, is limited by cost and availability. Typically the base material is vulcanized to form the elastomer. For low cost materials, such as a rubber-based material known as EPDM, chemical accelerators are used to accelerate the vulcanizing process. This reduces manufacturing time. However, the accelerators do not consistently bond tightly to the base rubber matrix. As the chemical accelerator diffuses over time to the roller surface, certain chemicals act as lubricants which slowly reduce the COF(rm).

With regard to adjunct materials, fillers and modifiers sometimes are added to the base material to increase the COF(rm). The fillers and modifiers, which often include oils, tend to soften the elastomers and increase COF(rm). However, softer elastomers are more difficult to grind to a precise diameter. Thus, drive rollers with tight tolerances use firmer elastomers and are less able to take advantage of the adjunct materials. For elastomers receiving adjunct materials, the adjunct materials do not always bond tightly to the base material. Thus, portions of adjunct material may diffuse to the roller surface. One effect is that the roller properties may change as the portions diffuse from the base material. The resulting material can change to a lower COF(rm).

With regard to the surface finish of the roller, the texture of the surface can strongly impact the COF(rm). A creped surface having hills and valleys, for example, tends to have a higher COF(rm) than a smooth surface. The crepe tends to sustain a higher COF(rm) for several reasons. Dirt and other contaminants, for example, are lost in the texture and do not adversely affect the COF(rm). Also, the creped surface of a drive roller is slightly more compliant, and thus, softer, than the bulk of the elastomer forming the roller. The texture adds a "spring-like" quality to the outer surface. Because the creped surface is more flexible and dynamic than a smooth surface, contaminants and oxidized rubber are more likely to break free and be scrubbed off the roller surface.

The base material with adjunct material additions forms an elastomer which is ground down to a drive roller having a prescribed diameter. Conventionally grinding rollers are applied to the drive roller to wear down the drive roller to a precise diameter. Conventional methods for adding texture to the drive roller surface are to increase the abrasiveness of the grinding rollers or to increase the pressure applied by the grinding rollers. The grinding process typically is a high force, short duration process in which a grinding wheel of approximately 6–10 inches in diameter spins at 3000 rpm to grind down a roller diameter by approximately 0.01 inches within 1 or 2 seconds.

The last factor recited above as affecting COF(rm) is the selection of chemicals used for cleaning contaminated rollers. By removing oils or other lubricating contaminants from the drive roller, the COF(rm) may revert approximately to a prior COF(rm) value. The conventional cleaning process, however, does not improve the surface crepe. Also, peripheral problems associated with solvent-type chemicals arise, (e.g., dealing with health hazards, fire hazards, shipping problems, disposal problems, and other environments concerns).

Accordingly textured, crepe-like surfaces are desirable for creating a high friction drive roller surface. Further, alternatives to chemical cleaning of contaminated drive rollers are desirable for restoring the COF(rm).

SUMMARY OF THE INVENTION

According to the invention, a method and apparatus is achieved for creating or restoring a high friction surface to a drive roller. Abrasive pads define a scrubbing surface for acting upon a media roller's surface. As the roller's surface is scrubbed, creping occurs which increases the surface's coefficient of friction, and more particularly, the coefficient of friction between the roller and media sheet, ("COF(rm)").

According to one aspect of the invention, the roller surface first is cleaned, then creped to "restore" a high friction surface. By approximately defining the force applied between the roller and abrasive pads and by using an abrasive pad of known grit, a scrubbing action initially removes surface contaminants from the roller surface. Over time, the elastomer surface becomes clean, then fatigued. As fatigue occurs, the surface tears causing creping. The creped surface gives the roller surface an increased coefficient of friction.

According to another aspect of the invention, the creping apparatus is a passive device positioned adjacent to a drive roller while a drive roller spins. As the roller spins, the roller's elastomer surface scrubs against the apparatus' abrasive pads.

In one embodiment the creping apparatus is formed by a pair of plates hinged along one edge and open along an opposite edge. A spring is positioned between the plates biasing the plates apart at the open end. One or more abrasive pads are attached to the outer surface of one plate. The spring is selected so as to provide a specific biasing force at a known deflection. The specific biasing force defines a controlled force between the drive roller and abrasive pads during operation. As the drive roller spins a torque moment is applied by the drive roller to the creping apparatus. Should the creping apparatus rotate so that the abrasive pad contacts external surfaces other than the roller's elastomeric surface, the controlled force between abrasive pad and elastomeric surface is reduced. To maintain the controlled force it is desirable to isolate the abrasive pad plate from external surfaces, other than the elastomeric surface. To achieve isolation a base frame of the apparatus includes buffer edges which limit the rotation of the creping apparatus during the torque moment applied by the drive roller.

According to another aspect of the invention, the drive roller surface is restored without removing the roller from the media handling device (e.g., printer, fax machine). The creping apparatus is temporarily inserted into the media handling device in place of a media input tray. The abrasive pad is positioned adjacent to the elastomer surface of the drive roller. The media handling device then is operated to spin the drive roller. The creping apparatus and more particularly, the abrasive pad is held in place adjacent to the drive roller by the force of the roller on the abrasive pad. The force of rotation of the drive roller along with the biasing force exerted by the spring define a specific force exerted on the elastomer surface of the drive roller. A crepe texture forms on the roller surface as the drive roller spins.

According to another aspect of the invention, a high friction surface is applied originally to manufacture a drive roller having a high friction surface. When manufacturing a drive roller, the roller typically is ground to a desired diameter using conventional grinding rollers. Once the desired diameter is achieved or nearly achieved, the roller is held to the creping apparatus and spun. By approximately defining the force applied between the roller and creping apparatus and by using an abrasive pad of known grit, the elastomer surface becomes fatigued after the first few minutes. Thereafter, the roller surface starts to tear resulting in a creped surface having an increased and more durable coefficient of friction.

According to another aspect of the invention, (i) the force between the roller and creping apparatus, (ii) the grit of the abrasive pad, (iii) the time during which the roller is spun while subject to the force, and (iv) the RPM of the drive roller are defined to first clean a roller surface, then fatigue and crepe the surface. The process tends to be of prolonged duration and modest force compared to conventional grinding operations used during original manufacture. Conventional grinding operations use large forces for short times to grind away the surface. The faster conventional process does not use fatigue characteristics of the surface material to wear down the surface. The slower, smaller force process of this invention takes advantage of surface fatigue to crepe the surface. By fatiguing the surface the surface is softened. The softened surface tears as scrubbing continues so as to yield a creped surface. This contrasts with the conventional high force, short duration grinding methods which prefer working on harder materials so grinding is more easily controlled. The slower, smaller force process of this invention also allows for effective application of a passive pad-based creping apparatus. Further, by first cleaning and fatiguing the roller surface, the surface tends to maintain a uniform shape and diameter during the scrubbing.

According to another aspect of this invention, a controlled force of 500 to 1000 grams is applied between the drive roller and abrasive pad as the roller spins to define a scrubbing action. During the first several minutes of scrubbing (e.g., 4 minutes), the roller's elastomeric surface is cleaned of contaminants. Thereafter, the surface becomes fatigued. As scrubbing continues, small pieces of the surface tear away. After 5–10 minutes of scrubbing action a creped surface is left which has a higher coefficient of friction.

One advantage of the invention, is that a high friction surface can be restored to drive rollers without removal of the drive roller from the media handling device. End users can readily insert the creping apparatus and initiate the scrubbing operation for a prescribed period of time. Maintenance becomes more user friendly. In effect, the life cycle of the drive roller can be increased. Another advantage of the invention is the scrubbing operation cleans the drive roller surface without chemicals. Thus, the storage, handling, disposal and other environmental problems commonly associated with cleaning chemicals are avoided.

These and other aspects and advantages of the invention will be better understood by reference to the following detailed description taken in conjunction with the accompanying drawings.

DESCRIPTION OF SPECIFIC EMBODIMENTS

Overview

Figure 1:
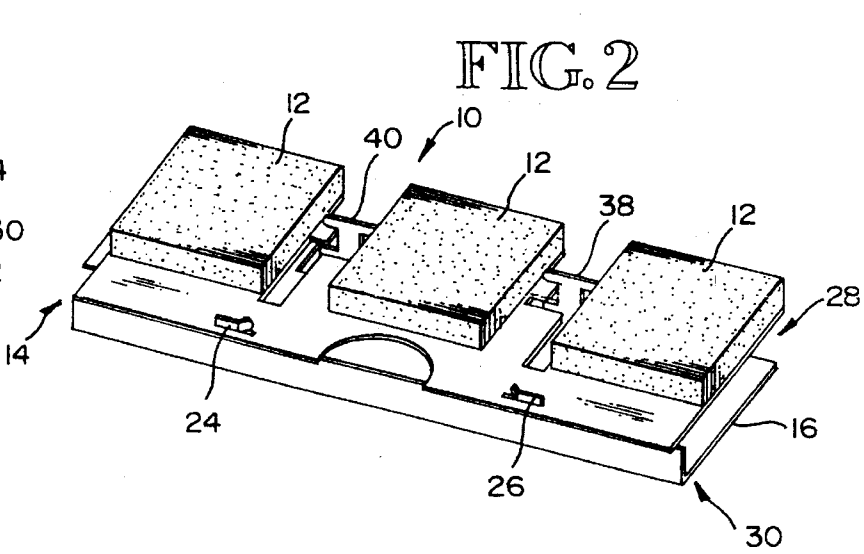
FIG. 1 is a perspective view of the creping apparatus according to one embodiment of this invention.
Figure 2:
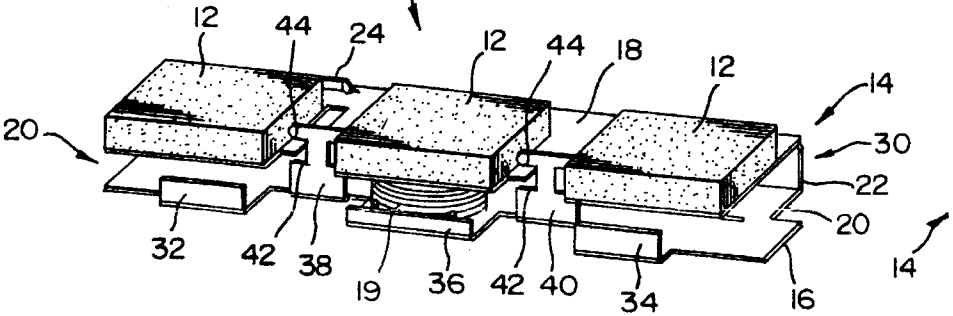
FIG. 2 is another perspective view of the creping apparatus of FIG. 1.
Figure 3:
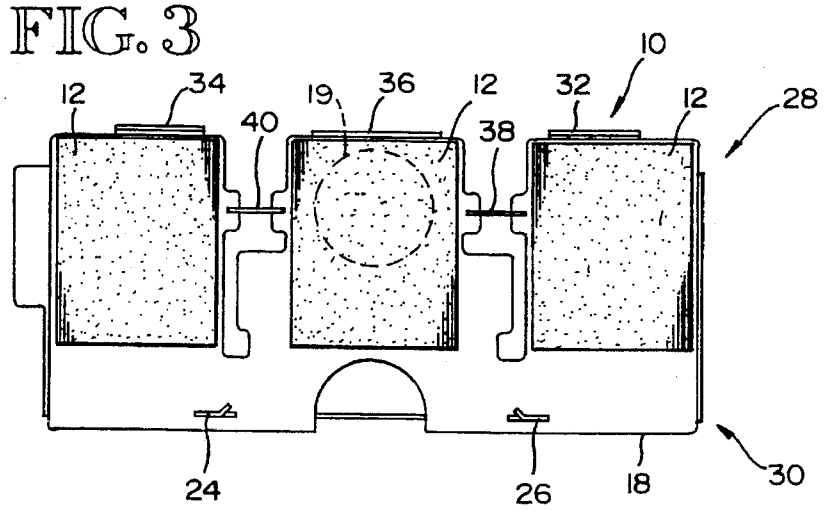
FIG. 3 is a plane top view of the creping apparatus of FIG. 1.
Figure 4:
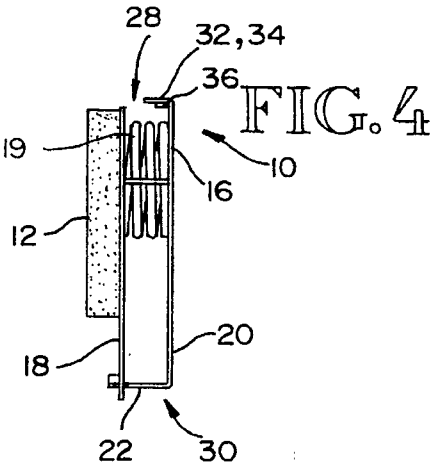
FIG. 4 is a plane side view of the creping apparatus of FIG. 1.

FIG. 1 shows a perspective view of the creping apparatus 10 according to one embodiment of the invention. The creping apparatus 10 acts upon a media roller of a media handling device to create or restore a high friction surface to the roller.

In media handling devices such as computer printers and plain paper fax machines, a sheet of media (e.g., paper, transparency) is transported along a media path so a device-head (e.g., print-head, fax-head) can output character or graphic markings onto the media sheet. Typically, a series of media rollers positioned at intervals along the media path move a sheet progressively through the media handling device.

Conventional media rollers have an elastomeric surface for contacting the media. In some instances the surface spans the length of the roller. In other instances the surface is formed as "tires" in parallel along the roller. Each roller is driven/spun by a motor(s) or other drive mechanism. A roller is referred to herein as an elastomeric roller or a drive roller.

During transport of a media sheet, a normal force is applied between the media sheet and the drive roller. To effectively pick a sheet from a stack and transport the sheet through the media handling device, it is desirable that the drive roller have a high friction surface. In particular the coefficient of friction between a drive roller and a media sheet ("COF(rm)") should exceed a specific level. Typical values for COF(rm) are 1.4 to 1.8. Over time the COF(rm) often decreases as contaminants lubricate the roller surface. This invention addresses a method and apparatus for restoring a high friction surface to a media roller. This invention also address a method and apparatus for originally creating a high friction surface on a media roller.

Creping Apparatus

As shown in FIGS. 1–4 the creping apparatus 10 includes one or more abrasive pads 12 which act upon a roller surface. Also included is a base assembly 14 to which the pads are adhered, fastened or otherwise coupled. In a preferred embodiment the pads are permanently attached to base assembly 14. In other embodiments the pads 12 are removably attached to base assembly 14.

The abrasive pads 12 are formed by sandpaper, smooth nylon or other abrasive material. In the illustrated embodiment the abrasive pads 12 are formed by compliant SCOTCHBRITE™ pads having a medium grit (e.g., 3M Corporation part no. 7447). A wide variety of abrasive pads may be used, however, ranging from smooth nylon to alternative SCOTCHBRITE™ pad grits, including a wide variety of sandpapers.

In the illustrated embodiment, the base assembly 14 is formed by a base frame 16, support plate 18, and spring member 19. The base frame 16 has a base plate area 20 and hinge portion 22. The support plate 18 couples to the base frame 16 via hinge structures 24, 26 formed in the hinge area 22. The spring member 19 is positioned between the base frame 16 and support plate 18 to keep the support plate 18 away from the base plate area 20. The base assembly 14 defines an open edge 28 and a hinged edge 30. Along the open edge 28, base frame 16 includes turned up edges 32, 34, 36. In one embodiment the base assembly 14 is formed from steel or another generally rigid material. Along the open edge 28, the base frame 16 also includes deflection limiters 38, 40. Each limiter 38, 40 includes a first edge 42 which limits travel of the support plate 18 in a first direction and a second edge 44 which limits travel of support plate 18 in a second opposite direction.

In an alternative embodiment (not shown) the base assembly 14 is formed by a unitary structure in which the base frame 16 and support plate 18 are integral. Compliance in the assembly 14 at an area corresponding to the hinge portion 22 of the illustrated embodiment provides a bias separating the support plate 18 and base frame 16. Such bias provides a controlled force between abrasive pads and drive roller.

In preferred embodiments, a bias force ranging from approximately 1000 grams to approximately 2500 grams is implemented for an approximately 0.5 inch separation between support plate 18 and base frame 16 at open edge 28. In the illustrated embodiment spring member 19 provides the bias force. A controlled force of 500 to 1000 grams between the abrasive pads 12 and drive roller results.

Method for Restoring High Friction Surface

Figure 5:
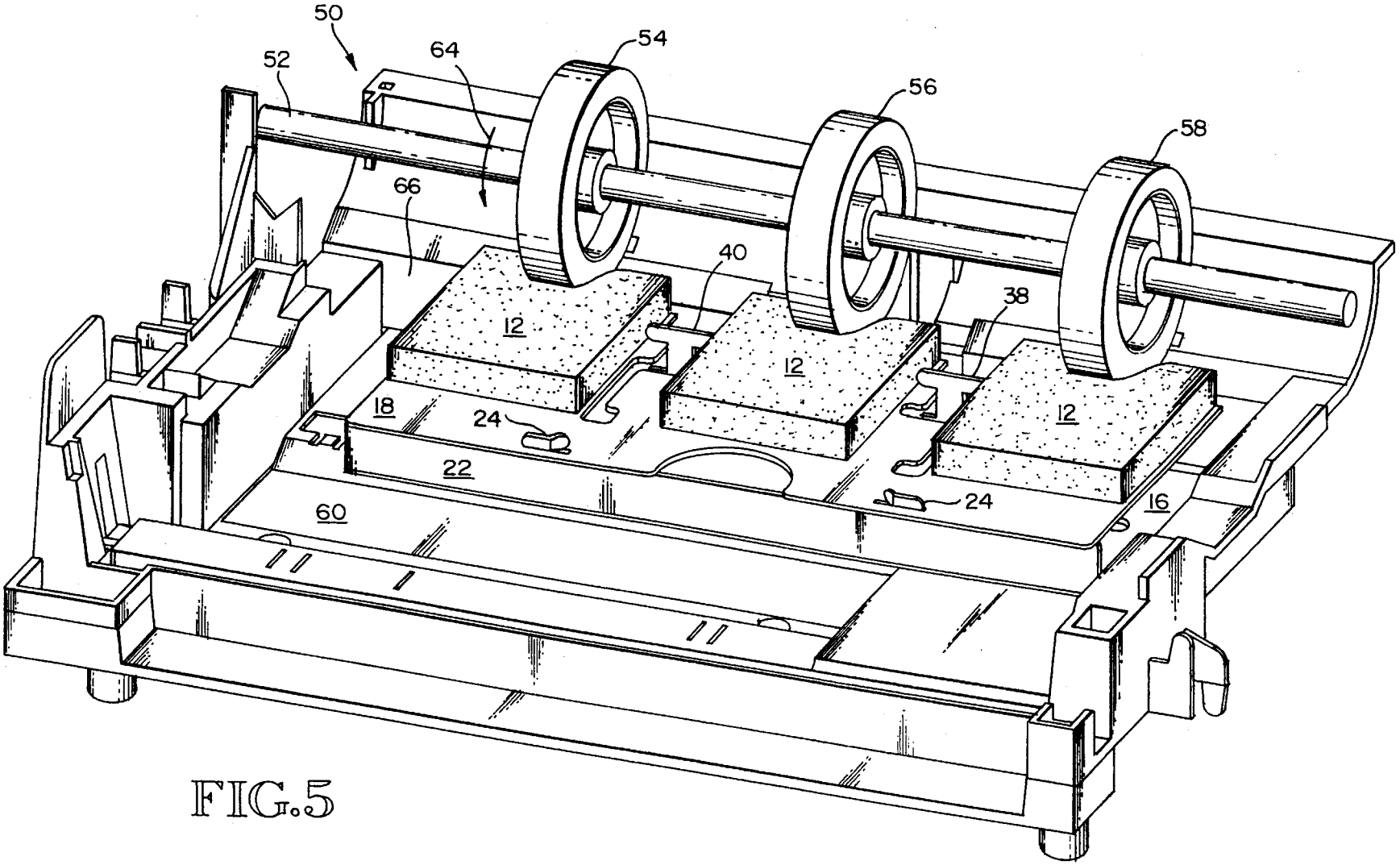
FIG. 5 is a perspective view of the creping apparatus of FIGS. 1–4 temporarily installed in a media handling device.

To restore a high friction surface to a media roller, the creping apparatus 10 is inserted into a media handling device. FIG. 5 shows a portion of a media handling device 50, including drive roller 52 with parallel elastomeric "tire" surfaces 54, 56, 58. Creping apparatus 10 is inserted into the paper tray area 60 of device 50. Typically the open end 28 is compressed while inserting the creping apparatus 10. Apparatus 10 is pushed up against the elastomeric surfaces 54–58 of roller 52. Edges 32–36 provide blunt surfaces for contacting the media handling device chassis during insertion, thereby avoiding damage to the chassis.

With apparatus 10 in place a host computer (not shown) sends control commands to turn the drive roller 52. Typically the roller is spun in a downward direction 64 into the abrasive pads 12. It is desirable to exert a controlled force on the elastomeric surfaces 54–58 during treatment. With the apparatus 10 in position, the open edge 28 is compressed to a distance of approximately 0.5 inches between base frame 16 and support plate 18. More significantly, this induces a biasing force of between 1000 and 2500 grams on the support plate 18. This translates to a controlled force of approximately 500 to 1000 grams between the abrasive pads 12 and the elastomeric surfaces 54–58. In one embodiment a biasing force of approximately 2100 grams is implemented. As previously described the structure for creating the controlled and biasing forces may vary. Also, the separation distance between base frame 16 and base plate 18 may vary according to application. Of significance is that a generally controlled force is applied between the abrasive pads 12 and roller surfaces 54–58.

As the roller 52 spins, a moment arm is created at apparatus 10 causing the hinged edge 30 to lift up from the paper tray area 60 base. Should too great of a moment occur support plate 18 may bump into a forward edge 66 of the media handling device chassis. Such external pressure applied to the support plate 18 would counter the bias force induced by the spring member 19. To prevent such a moment, the base frame 16 includes the turned up edges 32, 34. These edges 32, 34 will travel to the forward edge 66 during operation blocking the support plate 18 from contacting such edge 66. As a result, the controlled force is maintained between pads 12 and surfaces 54–58.

A conventional roller 52 includes elastomeric surfaces 54–58 formed, for example, of EPDM or other rubber or elastomer material. In addition adjunct materials and chemical accelerators may be included. A typical hardness for an inkjet printer roller, for example, is 45 durometers Shore A. To assure high friction, the surfaces 54–58 typically are creped to exceed a peak to valley measure of 200 micro-inches. Once the surfaces 54–58 slicken due to lubricants or wear to less than approximately 150–200 micro-inches, the surfaces no longer function effectively to pick and transport media sheets.

According to the restoration method of this invention, a generally controlled force is applied using an abrasive pad of a known grit for a prolonged period of roller spinning to restore and improve the crepe surface to a peak to valley measure of between 250 and 500 micro-inches. It has been found that using too coarse a grit grinds down the surfaces 54–58 without substantially increasing surface friction. It also has been found that applying a controlled force within a specific range (for a given grit and given roller hardness) for a prolonged period of time acts to create a durable high friction surface to an elastomer roller.

As the roller 52 spins, the abrasive pads 12 act on the surfaces 54–58 to break up the contaminants and remove the undesired lubricants adhering to the surfaces. Through testing in which the roller 52 is spun (e.g., at approximately 40 rpm), the surfaces 54–58 are "scrubbed" during the first few minutes cleaning the surfaces. As the scrubbing continues, the elastomer surfaces 54–58 begins to fatigue. As fatigue sets in the surfaces 54–58 start to tear. Small rolls of rubber of approximately 0.2 to 1.0 mm in diameter and 0.2 to 3.0 mm in length form and gather on the drive roller, the abrasive pad and the paper tray area. These are to be removed before returning to normal operation of the media handling device. A creped surface results after about 5 to 10 minutes of spinning the drive roller 52. The hills tend to be smaller and more radial than the original crepe achieved using conventional grinding rollers. The pattern also yields an improved and durable COF(rm).

For the conventional 45 durometer Shore A elastomer roller surface, a controlled force of between 500 and 1000 grams applied between abrasive pad and roller surface first cleans and fatigues the surface during the first few minutes (e.g., approximately 4 minutes) for a roller spinning at 40 rpm. Thereafter the surface more readily tears as the fatigued surface is scrubbed. As scrubbing continues a desired creping surface forms, thereby restoring a high friction surface. A durable surface having a high friction surface and a crepe between 250–500 micro-inches is achieved over a course of approximately 10 minutes. Durations of 5 minutes or more have been found to be effective. Durations closer to 10 minutes are used to achieve surface at the higher end of the 250–500 microinch range. Similar results are achievable for other elastomeric surfaces of varying hardness.

One advantage of this method is that the creping surface is restored without significantly altering the roller diameter. Such roller diameters are specified to tolerance and it would be undesirable to significantly grind the surface. By properly selecting a grit level (such as by experimentation for different roller hardnesses), grinding can be avoided. Accordingly, the action applied by the creping apparatus of this invention is more accurately described to be scrubbing, rather than grinding.

In alternative applications, the time duration may vary depending on the magnitude of the controlled force, the rpm of the roller, the hardness of the surface, the abrasive grit used and the desired frictional increase sought.

In one embodiment the drive roller is commanded to stop periodically, then ramp up again to the desired rpm. Thus, if drag inadvertently stops the roller during the operation, the command to stop and re-start generates a desirably increased motor torque to get the roller spinning again. In one embodiment, the roller was stopped every 20 seconds, then re-ramped to 40 rpm.

Method for Creating High Friction Surface

To originally manufacture a high friction surface at a drive roller, relative positions between the drive roller and the creping apparatus 10 are substantially fixed so that a controlled force is applied between the roller's elastomeric surface(s) and the abrasive pad(s) 12. The roller then is spun relative to the abrasive pad 12 inducing a scrubbing action. It is preferable that prolonged scrubbing occur without significantly grinding down the diameter of the roller. Accordingly, abrasive pads of a specific grit or less are identified by experimentation for a given roller hardness. For a 45 durometer Shore A EPDM elastomer surface a medium grit SCOTCHBRITE™ pad applied at a controlled force of between 500 and 1000 grams achieves scrubbing action. Initially the surface resists significant creping. However, as the surface fatigues during the course of scrubbing, the surface begins to tear. Small rolls of rubber come off the roller creating a creped surface with hills generally smaller and more radially oriented than those achieved using conventional grinding processes. A durable surface having a high friction surface and a crepe between 250–500 micro-inches is achieved over a course of approximately 10 minutes. Durations of 5 minutes or more have been found to be effective. Durations closer to 10 minutes are used to achieve surface at the higher end of the 250–500 micro-inch range.

Problem and Means for Solving Problem

One problem addressed by the methods and apparatus of this invention is how to restore a high friction surface to a media roller. During the life of a media handling device, the media roller tends to get contaminants including oils and other lubricants acting upon the media surface. The rollers of inkjet printers, for example, have experienced a problem with chemical accelerators which diffused to the surface and reduced the surface friction reducing the device reliability for picking paper. The creping apparatus can be easily inserted between the drive roller and paper tray of the media handling device. As the drive rollers spin while the creping apparatus is in position, the contaminants are scrubbed from the surface. Over time the surface also becomes fatigued and pieces of elastomer begin to tear away. A creped surface results having an increased coefficient of friction.

Another problem addressed by the invention is how to clean drive rollers without chemical solvents. Because the cleaning solvents typically require special handling, storage and disposal, an alternative "greener" cleaning method is desirable. The scrubbing action as described above, performs such a cleaning function.

Another problem addressed by the invention is how to apply a creped surface to a softer surface. Conventional grinding methods used in originally forming a roller have difficulty controlling roller characteristics when the roller is formed by soft elastomers. According to the invention, a lesser force applied over a longer time period using the crepe apparatus effectively crepes the roller surface, even for soft elastomers. The elastomers are softened by fatigue to enable effective creping.

Meritorious and Advantageous Effects

One advantageous effect of the invention is that a high friction surface can be restored to a drive roller without removing the roller from the media handling device. This enables end users rather than trained maintenance personnel to perform the restoration. For example, the apparatus may be sold to end users as a kit with instructions and a simple software program for issuing commands to a printer to spin the drive roller at a prescribed rpm, duration and intermittent start/stop period. Another advantageous effect is that cleaning of the roller is achieved without chemicals.

Although a preferred embodiment of the invention has been illustrated and described, various alternatives, modifications and equivalents may be used. For example, although the abrasive pad is illustrated to have a cube or block-like shape, abrasive pad as used herein encompasses alternative shapes, including a cylindrical roller, a substantially flat surface or other shape. The description of the specific embodiments should not be taken as limiting the scope of the inventions which are defined by the appended claims.

What is claimed is:

1. A method for applying a frictional texture to an elastomeric surface of a media roller, comprising the steps of:

applying an abrasive pad to the elastomeric surface at a controlled force, the abrasive pad attached to a support plate, the support plate movable relative to a base frame along a first edge of the support plate and fixed relative to the base frame toward a second edge of the support plate, the support plate and base frame forming a base assembly having an open edge and a hinged edge between the support plate and base frame, the base frame comprising a deflection limiting structure which limits travel of the support plate first edge in a first direction relative to the base frame;

spinning the media roller relative to the abrasive pad to scrub the elastomeric surface without significantly reducing roller diameter; and fatiguing the elastomeric surface via scrubbing action between the abrasive pad and elastomeric surface; and wherein pieces of the elastomeric surface tear away during the step of fatiguing leaving a textured surface having an increased coefficient of friction.

2. The method of claim 1, in which the controlled force is of at least approximately 500 grams, and in which the steps of spinning and fatiguing continue for a time of at least approximately 5 minutes.

3. The method of claim 1, in which the controlled force is between approximately 500 grams and approximately 1000 grams.

4. A method for increasing friction of an elastomeric surface of a media roller within a media handling device, comprising the steps of:

inserting a passive scrubbing apparatus into the media handling device at a media sheet path adjacent to the media roller, the scrubbing apparatus comprising an abrasive pad and a base assembly, the base assembly comprising a support plate to which the abrasive pad is attached and a base frame mechanically coupled to the support plate, the support plate movable relative to the base frame along a first edge of the support plate and fixed relative to the base frame toward a second edge of the support plate, the base assembly defining an open edge and a hinged edge between the support plate and base frame, the base frame comprising a deflection limiting structure which limits travel of the support plate first edge in a first direction relative to the base frame;

biasing the abrasive pad toward the elastomeric surface at a controlled force;

spinning the media roller relative to the abrasive pad to scrub the elastomeric surface without significantly reducing roller diameter over a time period which induces fatigue to the elastomeric surface; and wherein initially the controlled force acts to clean the elastomeric surface of contaminants, and subsequently to fatigue the elastomeric surface, while fatigued pieces of the elastomeric surface tear away resulting in creping the surface to increase surface coefficient of friction; and removing the passive scrubbing apparatus from the media handling device.

5. The method of claim 4, in which the controlled force is at least approximately 500 grams, and in which the steps of spinning and fatiguing continue for a time of at least approximately 5 minutes.

6. The method of claim 5 in which step of spinning is intermittent spinning during which the media roller is stopped and restarted.

7. The method of claim 4, in which the controlled force is between approximately 500 grams and approximately 1000 grams.

8. An apparatus removably inserted into a media handling system at a media path of the system, the system having a media roller for acting upon an elastomeric surface of the media roller to increase surface friction of the roller, the apparatus comprising:

an abrasive pad for scrubbing the elastomeric surface;

a base assembly to which the abrasive pad is attached, the base assembly comprising: a support plate, a base frame and a biasing means, in which the abrasive pad is attached to the support plate and the base frame is mechanically coupled to the support plate, and wherein the biasing means is for applying a controlled force between the abrasive pad and the elastomeric surface via the support plate, the applying means positioned between the base frame and support plate for biasing the support plate with abrasive pad toward the media roller while the apparatus is inserted in the media handling system; and wherein the support plate is movable relative to the base frame along a first edge of the support plate and fixed relative to the base frame toward a second edge of the support plate, and wherein the abrasive pad scrubs the elastomeric surface as the roller spins to clean and fatigue the surface over time and cause pieces of the elastomeric surface to tear away from the fatigued surface so as to increase surface coefficient of friction.

9. The apparatus of claim 8, in which the controlled force is at least approximately 500 grams.

10. The apparatus of claim 9, in which the controlled force is applied for a time of at least approximately 5 minutes.

11. The apparatus of claim 8, in which the controlled force is within the range of approximately 500 grams and approximately 1000 grams and is applied for a time of at least approximately 5 minutes.

12. The apparatus of claim 8, in which the base frame and support plate are open at a first side toward the media roller and are coupled toward a second side away from the media roller.

13. The apparatus of claim 8, in which the base assembly defines an open edge and a hinged edge between the base frame and support plate, the open edge comprising the first edge of the support plate, the hinged edge comprising the second edge of the support plate, and wherein the base frame further comprises a deflection limiting structure which limits the travel of the support plate first edge in a first direction relative to the base frame.

14. The apparatus of claim 13 in which the deflection limiting structure further limits the travel of the support plate first edge in a second direction relative to the base frame, the second direction being opposite the first direction.

15. The apparatus of claim 13, in which the base frame further comprises a turned up edge along a portion of the open edge of the base assembly, in which the turned up edge contacts an adjacent media handling system surface while the media roller is spinning and isolates the support plate from the adjacent media handling system surface to prevent forces other than the controlled force and a force from the media roller from exerting pressure on the abrasive pad.

* * * * *